US008602828B2

(12) United States Patent
Li et al.

(10) Patent No.: US 8,602,828 B2
(45) Date of Patent: Dec. 10, 2013

(54) CONNECTOR ASSEMBLY

(75) Inventors: Zhan-Yang Li, Shenzhen (CN); Wen-Hu Lu, Shenzhen (CN); Po-Wen Chiu, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 74 days.

(21) Appl. No.: 13/368,423

(22) Filed: Feb. 8, 2012

(65) Prior Publication Data

US 2012/0329336 A1 Dec. 27, 2012

(30) Foreign Application Priority Data

Jun. 22, 2011 (CN) ..... 2011 1 0169410

(51) Int. Cl.
*H01R 13/64* (2006.01)

(52) U.S. Cl.
USPC ..... 439/680; 439/247

(58) Field of Classification Search
USPC ..... 439/79, 247, 248, 352, 357, 358, 677, 439/680, 681
See application file for complete search history.

(56) References Cited

U.S. PATENT DOCUMENTS

| | | | | | |
|---|---|---|---|---|---|
| 3,654,586 | A * | 4/1972 | Winkler | 439/295 |
| 5,342,221 | A * | 8/1994 | Peterson | 439/677 |
| 5,628,648 | A * | 5/1997 | Higgins et al. | 439/489 |
| 6,095,854 | A * | 8/2000 | Sommer et al. | 439/545 |
| 6,135,822 | A * | 10/2000 | Hwang | 439/680 |
| 6,159,054 | A * | 12/2000 | Ko | 439/680 |
| 6,860,765 | B1 * | 3/2005 | Spink, Jr. | 439/680 |
| 6,994,595 | B2 * | 2/2006 | Baker et al. | 439/680 |
| 7,462,067 | B1 * | 12/2008 | Whiteman et al. | 439/562 |
| 7,824,211 | B1 * | 11/2010 | Wu | 439/502 |
| 7,867,033 | B2 * | 1/2011 | Kumagai et al. | 439/620.01 |

* cited by examiner

*Primary Examiner* — Thanh Tam Le
(74) *Attorney, Agent, or Firm* — Altis Law Group, Inc.

(57) ABSTRACT

A connector assembly includes a receptacle connector and a plug connector. The receptacle connector includes a plurality of receiving cavities. At least one of the plurality of receiving cavities comprising a first receiving portion, a second receiving portion, and a separating plate that is located between the first receiving portion and the second receiving portion and spaced from the top wall. The plug connector includes a plurality of plug units engageable with the plurality of receiving cavities. At least one of the plurality of plug units includes a first plug portion, a second plug portion, and a separating slot located between the first plug portion and the second plug portion. The first plug portion is engaged with the first receiving portion. The second plug portion is engaged with the second receiving portion. The separating plate is received in the separating slot.

18 Claims, 3 Drawing Sheets

CONNECTOR ASSEMBLY

BACKGROUND

1. Technical Field

The present disclosure relates to a connector assembly capable of preventing incorrect insertion of a plug connector.

2. Description of Related Art

Connector assemblies may include a receptacle connector and a plug connector that can be inserted into the receptacle connector. The receptacle connector may include an insulating body and a plurality of receiving cavities defined in the insulating body. The plug connector may include a plurality of plug units. When the plug connector is engaged with the receptacle connector, the plurality of plug units is received in the plurality of receiving cavities for signal transmission. However, the receptacle connector and the plug connector may sometimes be symmetrically-structured, and the plug connector may be engaged with the receptacle connector in an improper direction.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation. In the figures of the accompanying drawings in which like references indicate similar elements. It should be noted that references to "an" or "one" embodiment in this disclosure are not necessarily to the same embodiment, and such references mean at least one.

Figure 1:
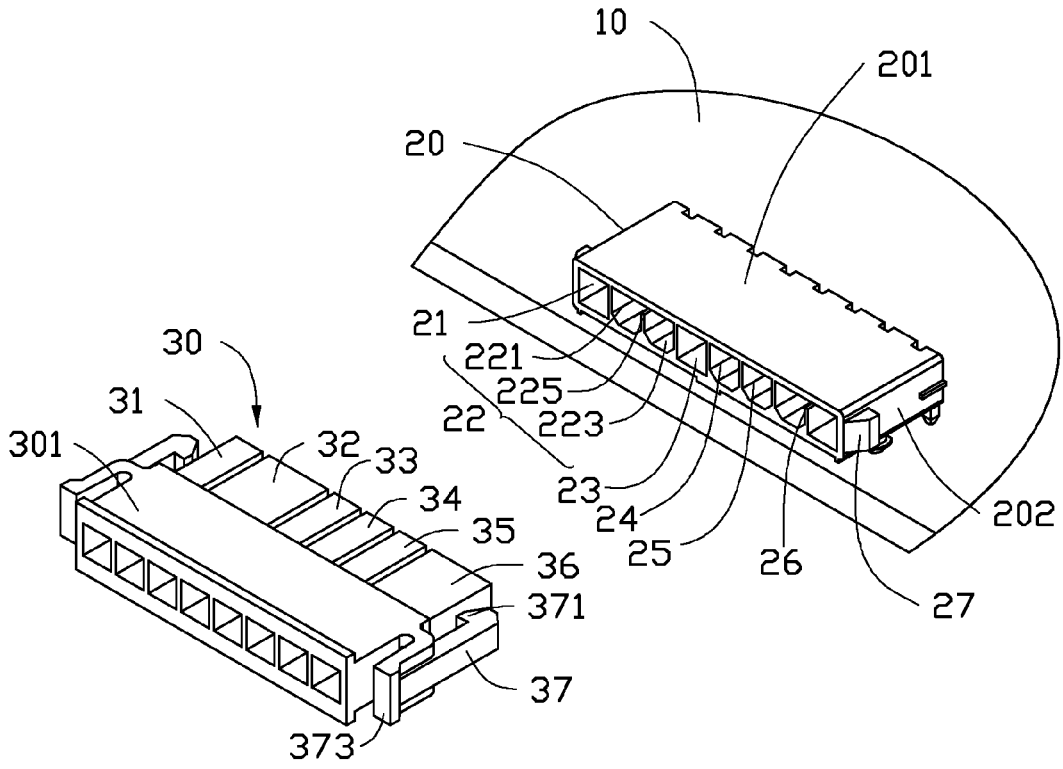
FIG. 1 is an exploded view of a connector assembly according to an embodiment.
Figure 2:
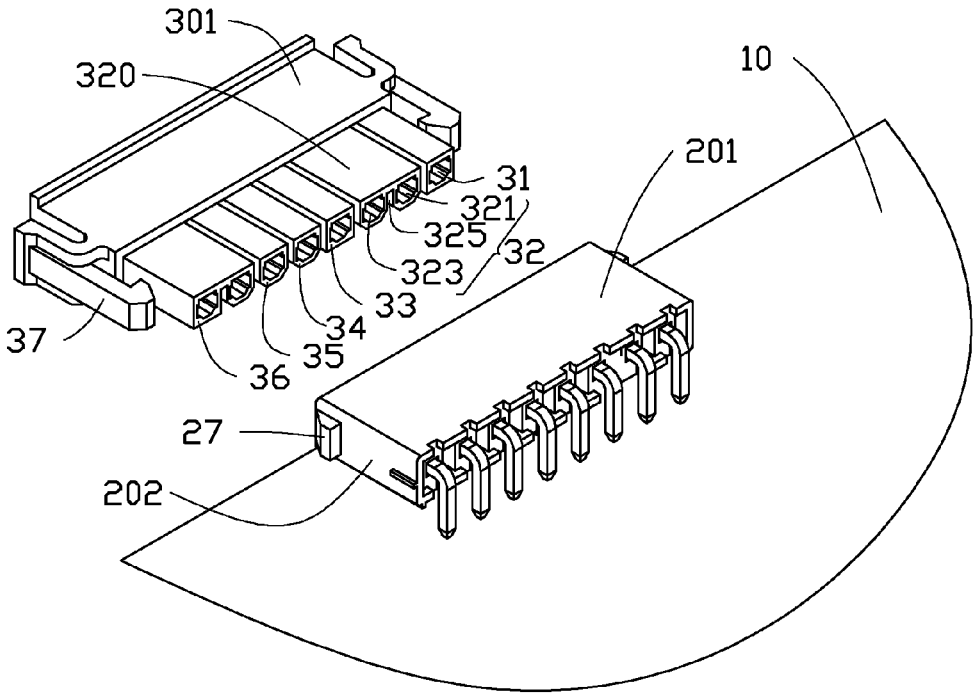
FIG. 2 is similar to FIG. 1, but viewed from another aspect.

Referring to FIGS. 1 and 2, is an embodiment of a connector assembly including a receptacle connector 20 and a plug connector 30 engageable with the receptacle connector 20. The receptacle connector 20 is mounted on a circuit board 10.

The receptacle connector 20 includes a top wall 201, a pair of sidewalls 202 substantially perpendicularly connected to opposite sides of the top wall 201, and a wedge-shaped protrusion 27 protruding from each of the pair of sidewalls 202. A plurality of receiving cavities is defined in the receptacle connector 20. In one embodiment, the plurality of receiving cavities includes a first receiving cavity 21, a second receiving cavity 22, a third receiving cavity 23, a fourth receiving cavity 24, a fifth receiving cavity 25, and a sixth receiving cavity 26. A cross-section of the first receiving cavity 21 is rectangular or square-shaped. A cross-section of the second receiving cavity 22 is shaped like an inverted B shape. The second receiving cavity 22 includes a first receiving portion 221 adjacent to the first receiving cavity 21, a second receiving portion 223 adjacent to the third receiving cavity 23, and a separating plate 225 located between the first receiving portion 221 and the second receiving portion 223. The separating plate 225 is substantially perpendicular to the top wall 201 and spaced from the top wall 201. The third receiving cavity 23 has the same shape and the same size as the first receiving cavity 21. The fourth receiving cavity 24 and the fifth receiving cavity 25 have the same shape and the same size. A cross-section of each of the fourth receiving cavity 24 and the fifth receiving cavity 25 has an axially symmetrical hexagon shape. The sixth receiving cavity 26 has the same shape and the same size as the second receiving cavity 22.

The plug connector 30 includes a main body 301 and a plurality of plug units protruding from the main body 301. In one embodiment, the plurality of plug units includes a first plug unit 31 engageable with the first receiving cavity 21, a second plug unit 32 engageable with the second receiving cavity 22, a third plug unit 33 engageable with the third receiving cavity 23, a fourth plug unit 34 engageable with the fourth receiving cavity 24, a fifth plug unit 35 engageable with the fifth receiving cavity 25, and a sixth plug unit 36 engageable with the sixth receiving cavity 26. A periphery of a cross-section of the first plug unit 31 can be rectangular or square-shaped. A periphery of a cross-section of the second plug unit 32 is shaped like an inverted B shape. The second plug unit 32 includes a top plate 320, a first plug portion 321, and a second plug portion 323. The first plug portion 321 and the second plug portion 323 connect to a lower side of the top plate 320. A separating slot 325 is located between the first plug portion 321 and the second plug portion 323 and engageable with the separating plate 225. The third plug unit 33 has the same shape and the same size as the first plug unit 31. The fourth plug unit 34 and the fifth plug unit 35 have the same shape and the same size. A periphery of a cross-section of each of the fourth plug unit 34 and the fifth plug unit 35 has an axially symmetrical hexagon shape. The sixth plug unit 36 has the same shape and the same size as the second plug unit 32. The main body 301 includes a pair of side panels (not labeled) and a resilient arm 37 extending from each of the pair of side panels. A pressing portion 373 is located at a first end of the resilient arm 37 and protrudes towards an outer side of the resilient arm 37. A hook portion 371 is located at a second end of the resilient arm 37 and protrudes towards an inner side of the resilient arm 37.

Figure 3:
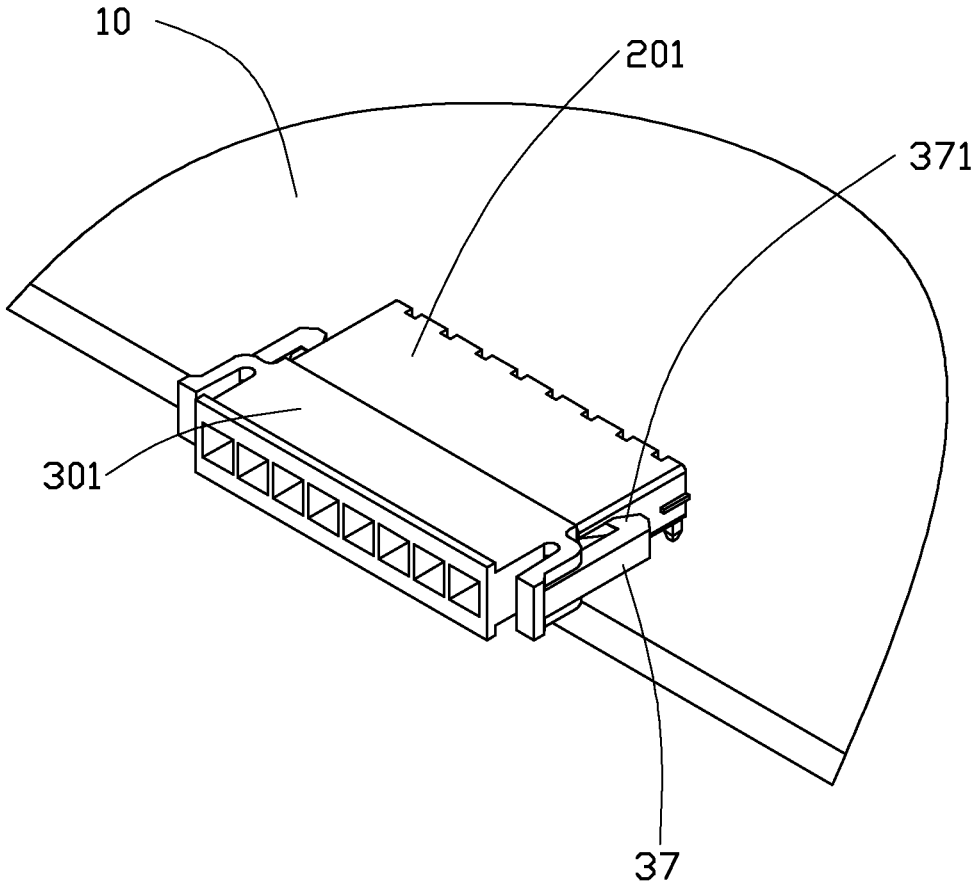
FIG. 3 is an assembled view of the connector assembly of FIG. 1.

Referring to FIG. 3, in assembly, the first plug unit 31 is inserted into the first receiving cavity 21. The second plug unit 32 is inserted into the second receiving cavity 22. The third plug unit 33 is inserted into the third receiving cavity 23. The fourth plug unit 34 is inserted into the fourth receiving cavity 24. The fifth plug unit 35 is inserted into the fifth receiving cavity 25. The sixth plug unit 36 is inserted into the sixth receiving cavity 26. The separating plate 225 is received in the separating slot 325. The top plate 320 is received in a space between the separating plate 225 and the top wall 201. The wedge-shaped protrusion 27 moves to engage with the hook portion 371 and deforms the resilient arm 37. After the hook portion 371 is moved across the wedge-shaped protrusion 27, the resilient arm 37 resumes its original position and the hook portion 371 hooks the wedge-shaped protrusion 27. Thus, the plug connector 30 is securely engaged with the receptacle connector 20.

To disconnect the plug connector 30 from the receptacle connector 20, the pressing portion 373 is pressed and moves towards the inner side of the resilient arm 37. The hook portion 371 is urged to move towards the outer side of the resilient arm 37 and disengages from the wedge-shaped protrusion 27. Then the plug connector 30 can be pulled out from the receptacle connector 20.

In one embodiment, the receptacle connector 20 and the plug connector 30 both have non-symmetrical structures, which prevents an incorrect insertion of the plug connector 30.

While the present disclosure has been illustrated by the description in this embodiment, and while the embodiment has been described in considerable detail, it is not intended to restrict or in any way limit the scope of the appended claims to such details. Additional advantages and modifications within the spirit and scope of the present disclosure will readily appear to those skilled in the art. Therefore, the present disclosure is not limited to the specific details and illustrative examples shown and described.

What is claimed is:

1. A connector assembly comprising:

a receptacle connector comprising a plurality of receiving cavities, a top wall and a pair of sidewalls extending from opposite sides of the top wall, the plurality of receiving cavities located between the pair of sidewalls, at least one of the plurality of receiving cavities comprising a first receiving portion, a second receiving portion, and a separating plate located between the first receiving portion and the second receiving portion and spaced from the top wall; and a plug connector comprising a plurality of plug units engageable with the plurality of receiving cavities, at least one of the plurality of plug units comprising a first plug portion, a second plug portion, and a separating slot located between the first plug portion and the second plug portion;

wherein the first plug portion is engaged with the first receiving portion, the second plug portion is engaged with the second receiving portion, and the separating plate is received in the separating slot; the at least one of the plurality of plug units comprises substantially flat a top plate, the first plug portion and the second plug portion connect to a lower side of the top plate, and the top plate is engaged between a space between the separating plate and the top wall.

2. The connector assembly of claim 1, wherein the plurality of receiving cavities comprise a first receiving cavity, a first cross-section of the first receiving cavity is rectangular or square-shaped, and the plurality of plug units comprise a first plug unit engageable with the first receiving cavity.

3. The connector assembly of claim 2, wherein the plurality of receiving cavities comprise a third receiving cavity thaving a shape and a size same as a shape and a size of the first receiving cavity, and the plurality of plug units comprise a third plug unit engageable with the third receiving cavity.

4. The connector assembly of claim 3, wherein the plurality of receiving cavities further comprise a fourth receiving cavity and a fifth receiving cavity, a second cross-section of each of the fourth receiving cavity and the fifth receiving cavity has a hexagon shape, and the plurality of plug units comprise a fourth plug unit engageable with the fourth receiving cavity and a fifth receiving cavity engageable with the fifth receiving cavity.

5. The connector assembly of claim 4, wherein a third cross-section of the at least one of the plurality of receiving cavities has an inverted B-like shape, and the plurality of receiving cavities comprise a sixth receiving cavity having a shape and a size same as a shape and a size of the at least one of the plurality of receiving cavities, and the plurality of plug units comprise a sixth plug unit engageable with the sixth receiving cavity.

6. The connector assembly of claim 5, wherein the at least one of the plurality of receiving cavities is located adjacent to and between the first receiving cavity and the third receiving cavity, the fourth receiving cavity is located adjacent to and between the third receiving cavity and the fifth receiving cavity, and the fifth receiving cavity is located adjacent to and between the fourth receiving cavity and the sixth receiving cavity.

7. The connector assembly of claim 1, wherein the plug connector comprises a main body and a pair of resilient arms extending from opposite sides of the main body, each of the plurality of plug units protrudes from the main body, each of the pair of resilient arms comprises a hook portion configured to hook on to the receptacle connector.

8. The connector assembly of claim 7, wherein a wedge-shaped protrusion protrudes from each of the pair of sidewalls, the hook portion is engaged with the wedge-shaped protrusion for securing the plug connector to the receptacle connector.

9. The connector assembly of claim 7, wherein the plug connector further comprises a pressing portion located at a first end of each of the pair of resilient arms, the hook portion is located at a second end of each of the pair of resilient arms, each of the pair of resilient arms is deformable by pressing the pressing portion.

10. A connector assembly comprising:

a receptacle connector comprising a top wall, a pair of sidewalls extending from opposite sides of the top wall, a first receiving cavity located beside one of the pair of sidewalls, and a second receiving cavity located beside the first receiving cavity; the second receiving cavity comprising a first receiving portion, a second receiving portion, and a separating plate between the first receiving portion and the second receiving portion and spaced from the top wall; and the first receiving cavity being shaped differently from the second receiving cavity; and a plug connector comprising a first plug unit engageable with the first receiving cavity and a second plug unit engageable with the second receiving cavity; the second plug unit comprising a first plug portion, a second plug portion, and a separating slot located between the first plug portion and the second plug portion; and the first plug unit being shaped differently from the second plug unit;

wherein the separating plate is received in the separating slot; the at least one of the first plug unit and the second plug unit comprises a substantially flat top plate, the first plug portion and the second plug portion connect to a lower side of the top plate, and the top plate is engaged between a space between the separating plate and the top wall.

11. The connector assembly of claim 10, wherein a first cross-section of the first receiving cavity is rectangular or square-shaped.

12. The connector assembly of claim 11, wherein the receptacle connector further comprises a third receiving cavity located beside the second receiving portion and has a shape and a size same as a shape and a size of the first receiving cavity, and plug connector further comprises a third plug unit engageable with the third receiving cavity.

13. The connector assembly of claim 12, wherein the receptacle connector further comprises a fourth receiving cavity located beside the third receiving cavity and a fifth receiving cavity located beside the fourth receiving cavity, the fourth receiving cavity and the fifth receiving cavity have a same shape and A same size, and the plug connector further comprises a fourth plug unit engageable with the fourth receiving cavity and a fifth receiving cavity engageable with the fifth receiving cavity.

14. The connector assembly of claim 13, wherein a second cross-section of each of the fourth receiving cavity and the fifth receiving cavity has a hexagon shape.

15. The connector assembly of claim 14, wherein a third cross-section of the second receiving cavity has an inverted B-like shape.

16. The connector assembly of claim 15, wherein the receptacle connector further comprises a sixth receiving cavity having a same shape and a size same as a shape and a size of the second receiving cavity, the sixth receiving cavity is located beside the fifth receiving cavity and beside another of the pair of sidewalls, and the plug connector further comprises a sixth plug unit engageable with the sixth receiving cavity.

17. The connector assembly of claim 10, wherein the plug connector comprises a main body and a pair of resilient arms extending from opposite sides of the main body, each of the first plug unit and the second plug unit protrudes from the main body, each of the pair of resilient arms comprises a pressing portion and a hook portion configured to hook on to the receptacle connector, the pressing portion and the hook portion are located at opposite ends of each of the pair of resilient arms, each of the pair of resilient arms is deformable by pressing the pressing portion.

18. The connector assembly of claim 17, wherein a wedge-shaped protrusion protrudes from each of the pair of sidewalls, the hook portion is engaged with the wedge-shaped protrusion for securing the plug connector to the receptacle connector.

* * * * *